US007825597B2

(12) United States Patent
Okanuma et al.

(10) Patent No.: US 7,825,597 B2
(45) Date of Patent: Nov. 2, 2010

(54) DISCHARGE LAMP

(75) Inventors: Tsuneo Okanuma, Hyogo (JP); Yoshio Kagebayashi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 768 days.

(21) Appl. No.: 11/783,953

(22) Filed: Apr. 13, 2007

(65) Prior Publication Data

US 2007/0242457 A1 Oct. 18, 2007

(30) Foreign Application Priority Data

Apr. 13, 2006 (JP) ..... 2006-110588

(51) Int. Cl.
*H05B 31/00* (2006.01)

(52) U.S. Cl. ..... 313/623; 313/624; 313/625; 313/631; 313/632; 362/261

(58) Field of Classification Search ..... 313/623–625, 313/634–636, 493, 318.12, 570, 578, 618, 313/631–632; 118/50; 445/26, 27; 362/261
See application file for complete search history.

(56) References Cited

U.S. PATENT DOCUMENTS 6,936,956 B2 8/2005 Ikeuchi et al.

FOREIGN PATENT DOCUMENTS

JP 2004-006246 A 1/2004
JP 2004-265663 A 9/2004
JP 2004265663 A * 9/2004

* cited by examiner

*Primary Examiner*—Bumsuk Won
*Assistant Examiner*—Elmito Breval
(74) *Attorney, Agent, or Firm*—Rader, Fishman & Grauer PLLC

(57) ABSTRACT

A discharge lamp has an electrode comprising a base portion having a base portion side flange portion, and a lid portion having a lid portion side flange portion. In a sealed space of the electrode, heat conductive member is enclosed. At time of lighting, the electrode is not damaged, and the discharge lamp can be stably operated. In the electrode, the diameter direction width of a welding portion of a base portion side flat portion and a lid portion side flat portion is 0.8 to 3.0. Further, an angle formed by the base portion side flat portion and a base side slope portion is 30 degrees or less and an angle formed by the lid portion side flat portion and a lid side slope portion is 30 degrees or less. The sum total of these angle is 160 degrees or less.

8 Claims, 3 Drawing Sheets

DISCHARGE LAMP

CROSS-REFERENCES TO RELATED APPLICATION

This application claims priority from Japanese Patent Application Serial No. 2006-110588 filed on Apr. 13, 2006, the contents of which are incorporated herein by reference in its entirety.

TECHNICAL FIELD

Described herein is a discharge lamp.

BACKGROUND

Although various types of discharge lamps are known from the past, among high-pressure mercury lamps in which mercury is enclosed in a light emission tube thereof, especially a short arc type high pressure mercury lamp is used, for example, as a light source of light exposing apparatus for light exposure processing of a semiconductor wafer, a liquid crystal substrate, etc., since it has light emission property in which i rays with a wavelength of 365 nm or g rays with a wavelength of 435 nm are emitted. In such a short arc type high pressure mercury lamp, a high output is strongly demanded so that expected exposure processing can be performed at high processing efficiency.

In order to make a high pressure mercury lamp with a high output, rated power is usually raised, but the rated current also increases. As a result, there is a problem that the anode of the high-pressure mercury lamp which is turned on according to direct current lighting, readily becomes high in temperature so that the anode melts since the quantity of electrons which collide with the anode increases. Moreover, in a high-pressure mercury lamp, in which a pair of electrodes facing each other is provided above and below, the electrode located in the upside becomes high in temperature so as to sometimes melt, due to heat from an arc, in addition to influence of the heat convection within an arc tube thereof etc. Since when the tip portion of an electrode melts, not only an arc becomes unstable, but the substance which forms the electrode also evaporates, thereby adhering to the inner wall of an arc tube, so that there is a problem that the intensity of light emitted from the high-pressure mercury lamp falls.

SUMMARY

In order to solve the above problems, in Japanese Laid Open Patent No. 2004-6246, an electrode is proposed in which a heat conductive member made of metal with a thermal conductivity higher than that of the metal which forms the electrode or metal with a melting point lower than that of the metal which forms the electrode is enclosed in the interior space formed inside the electrode member of a high-pressure mercury lamp.

In FIG. 1, a discharge lamp comprises an arc tube 10 having an approximately spherical arc tube portion 11 and sealing portions 12 which are serially formed from the both ends of the arc tube portion 11, respectively. In the arc tube portion 11, a pair of electrodes, that is, an anode 14 and a cathode 16 which are made of tungsten metal is arranged so as to face each other. In the anode 14, as shown in the FIG. 8, a cylindrical insertion portion 151 of a lid portion 150 is inserted in the interior space of a cylinder base portion 140 having a bottom. In the state where the insertion portion 151 is inserted therein, a flat portion of a flange portion 141 formed in a base end portion of the base portion 140 and a flat portion of a flange portion 152 formed at a tip portion of the lid portion 150 are brought into contact with each other, and these flat portions are welded entirely in a circumferential direction. In an enclosed space C formed in the anode 14, a heat conductive member M made of metal with thermal conductivity higher than tungsten metal which forms the anode, or metal with the melting point lower than tungsten metal is enclosed. In addition, in FIG. 8, an inner shoulder 142 is formed in the inner circumference face of the base portion 140, and the tip of the insertion portion 151 of the inserted lid portion 150 is brought into contact with the shoulder 142. A hole 153 is provided for connection of an electrode rod.

In the anode 14 having such a structure, at time of lighting of the discharge lamp, heat accumulated adjacent to the tip portion (a lower end portion in FIG. 8) of the anode 14 is transferred through the heat conductive member M at high efficiency toward the base end portion side of the anode 14 which is lower in temperature than the tip portion, so that it is possible to prevent the tip portion of the anode 14 from being overheated. Moreover, when the heat conductive member M is metal with a melting point lower than tungsten metal, it is possible to prevent the tip portion of the anode 14 from being overheated since heat of the tip portion of the anode 14 is transferred toward the base end portion side due to convection generated in the enclosed space C of the anode 14. Also refer to Japanese Laid Open Patent No. 2004-265663.

However, in the discharge lamp equipped with the anode having the above structure, exfoliation sometimes occurs in the welding portion of the base portion and the lid portion at time of starting of the discharge lamp and also cracks occur in the flange portion of the base portion and the flange portion of the lid portion at the time of welding. As a result, there is a problem that the heat conductive member begins to leak from enclosed space at the time of lighting of the discharge lamp.

In view of the above problem, it is an object of the present invention to offer a discharge lamp in which a base portion and a lid portion are welded to each other and a heat conductive member is enclosed in an internal sealing space, wherein an electrode is not damaged at time of lighting, and the discharge lamp can be operated stably.

The present discharge lamp comprises an arc tube; and a pair of electrodes arranged in the arc tube, wherein one of the electrode comprises a cylindrical metallic base portion having an opening at a base end portion and a bottom portion and a metallic lid portion having a cylindrical insertion portion, a metal having a thermal conductivity higher than that of the base portion or having a melting point lower than that of the base portion is enclosed in a sealed space formed by inserting the insertion portion of the lid portion and an interior of the base portion, and welding the lid portion and the base portion, the base portion has a base portion side flange portion which extends in a diameter outside direction, the base portion side flange has a base portion side flat portion which extends in the diameter direction, and a base portion side slope portion which is continuously formed from a base portion side flat portion perimeter edge of the base portion side flat portion, and extends toward a tip portion of the base portion in a diameter inside direction, the lid portion has a lid portion side main body including a lid portion side flange portion having a diameter approximately equal to an outer diameter of the base portion side flange portion, and an insertion portion, the lid portion side flange portion has a lid portion side flat portion which extends in a diameter outside direction and a lid portion side slope portion which is continuously formed from a lid portion side flat portion perimeter edge of the lid portion side flat portion, and extends toward the base end portion so as to incline toward the diameter inside direction, the insertion portion projects from the lid portion side flat portion, the base portion side flange portion and the lid portion side flange portion are welded entirely in a circumferential direction in a state where the base portion side flat portion and the lid portion side flat portion are brought into contact with each other so as to form a circular welding portion, and a diameter direction width of the circular welding portion is 0.8 to 3.0 mm.

In the present discharge lamp, a base portion side flange apex angle α in a cross section in an axis direction, formed by the base portion side flat portion and the base portion side slope portion may be an acute angle of 30 degrees or more, and a lid portion side flange apex angle β in a cross section in the axis direction, formed by the lid portion side flat portion and the lid portion side slope portion may be an acute angle of 30 degrees or more, and a sum total of the angle α and the angle β may be 160 degrees or less.

In the discharge lamp, a circumference surface of the base portion may have an annular groove which is formed in a circumference of the base portion, in which the base portion side slope portion is part of the annular groove. Moreover, in the discharge lamp, the diameter of the base portion side flange portion may be approximately equal to or less than that of a cylinder which forms the base portion.

In the present discharge lamp having an electrode in which the heat conductive member is enclosed in the sealed enclosed space formed by inserting the lid portion into the base portion, and they are welded, since the width of an annular welding portion in a diameter direction is 0.8 mm or more, it is possible to sufficiently improve durability of the anode against a force exerted in a direction in which the welded portion is ripped up from the inside of the electrode, specifically, a force exerted in a direction in which the lid portion is separated off the base portion. As a result, since the width of the welding portion in a diameter direction is 3.0 mm or less, it is possible not only to prevent the welding portion from being damaged at lighting of the discharge lamp, but also no excessive energy for welding is needed. Also, the temperature rise of a base portion, a lid portion, and a heat conductive member can be controlled since an expected result can be obtained by a short time welding operation, and deterioration of the heat transfer effect due to decrease of the amount of the heat conductive member does not occur since evaporation or boil of a heat conductive member do not arise. It is possible to prevent part of evaporated and dispersed heat conductive member from entering into the welding portion, so that the welding portion does not deteriorate and the strength of the welding portion does not become small.

Moreover, it becomes easy to weld a circumferential edge of the base portion side flange portion and a circumferential edge of the lid portion side flange portion by welding the flange portion of the base portion and the flange portion of the lid portion entirely in the circumference direction in the state where the flat portion of the lid portion is brought into contact with the flat portion of the base portion. Therefore, it is possible to certainly form, for a short time, the welding portion which has a width of 0.8 to 3.0 mm in the diameter direction, without excessive energy for welding. Furthermore, since the lid portion side flat portion is in contact with the base portion side flat portion so that the force added to the lid portion in case a welding rod is press-inserted so as to fit in the lid portion, is received by the base portion side flat portion which is brought into close contact with the lid portion side flat portion, it is possible to prevent this force from being applied to the welding portion. Therefore, it is possible to prevent cracks from being generated in the welding portion and also prevent a heat conductive member from leaking out into an electrical discharge space at time of lighting of a discharge lamp.

Moreover, the apex angle α in a cross portion in an axial direction of the base portion side flange portion (base portion side flange apex angle) is an acute angle of 30 degrees or less, and the apex angle β in a cross portion in an axial direction of the lid portion side flange portion (lid portion side flange apex angle) is an acute angle of 30 degrees or less. Further, when the sum total of the angles α and β is 160 degrees or less, it is possible to prevent generation of cracks in both the base portion side flange portion and the lid portion side flange portion even though a rapid temperature rise occurs locally by welding. Furthermore, it is possible to certainly form the welding portion with a width of 0.8 to 3.0 mm in the diameter direction. As a result, it is possible to prevent leakage of a heat conductive member from a sealed enclosed space at time of lighting of the discharge lamp. Therefore, in the present discharge lamp, the electrode is not damaged at the time of lighting and the discharge lamp can be operated stably.

Moreover, since an annular groove extending in a circumference direction at the position close to the base end portion is formed in the outer circumferential surface of a base portion, in which the annular groove is formed in the base portion side slope, and the outer diameter of the base portion side flange portion is equal to or less than the outer diameter of the cylinder of the base portion, it is possible to use the glass tube material for the conventional arc tube structure at time of the assembly of a discharge lamp, so that it is advantageous in respect of cost.

BRIEF DESCRIPTION OF DRAWINGS

Other features and advantages of the present discharge lamp will be apparent from the ensuing description, taken in conjunction with the accompanying drawings, in which.

DETAILED DESCRIPTION

Description of an embodiment will be given below, referring to drawings.

Figure 1:
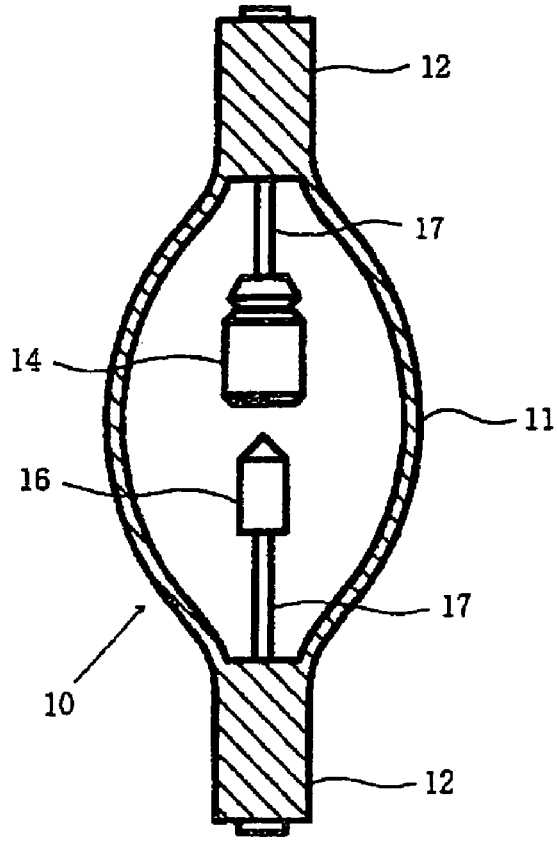
FIG. 1 is an explanatory cross sectional view showing the structure of an example of the discharge lamp according to an embodiment.

FIG. 1 is a cross sectional view of an example of the structure of the discharge lamp of the embodiment. An arc tube 10 is made of quartz glass and sealing portions 12 are integrally formed at the both ends of an approximately spherical arc tube portion 11. In the arc tube portion 11, a pair of electrodes, that is, an anode 14 and a cathode 16 which are made of metal respectively, is arranged so as to face each other, and electrode rods 17 extending therefrom are held by the respective sealing portions 12. Each of the electrode rods is connected to an external lead rod or an external terminal through a metallic foil (not shown) airtightly provided in the sealing portion 12, and an external power supply is connected to the external lead rod or the external terminal. And a predetermined amount of light emitting material or initiation gas, such as mercury, xenon, and argon, is enclosed in the arc tube portion 11.

In such a discharge lamp, by supplying electric power from the external power supply, arc discharge is generated between the anode 14 and the cathode 16 thereby emitting light. In addition, the discharge lamp is a so-called vertical setting lighting type discharge lamp in which the anode 14 is arranged above the cathode 16, i.e. the arc tube portion of the arc tube 11 is supported so that the tube axis thereof is vertical to the ground.

Figure 2:
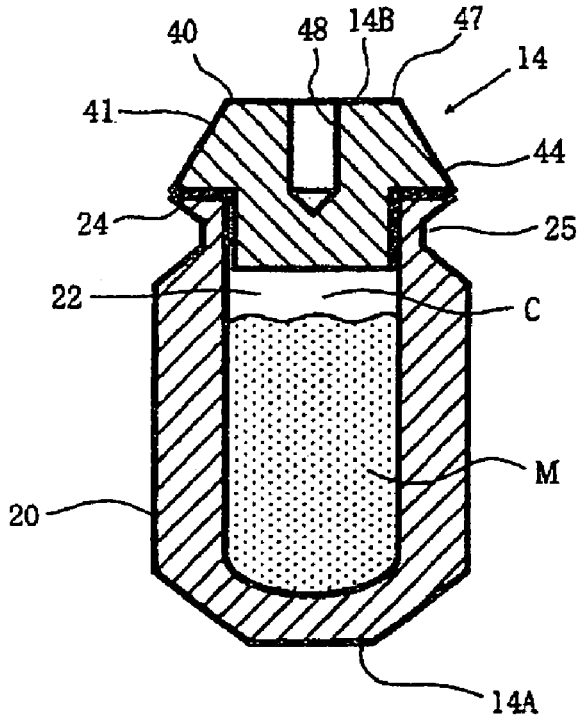
FIG. 2 is an enlarged cross sectional view of the anode of a discharge lamp of FIG. 1.
Figure 3:
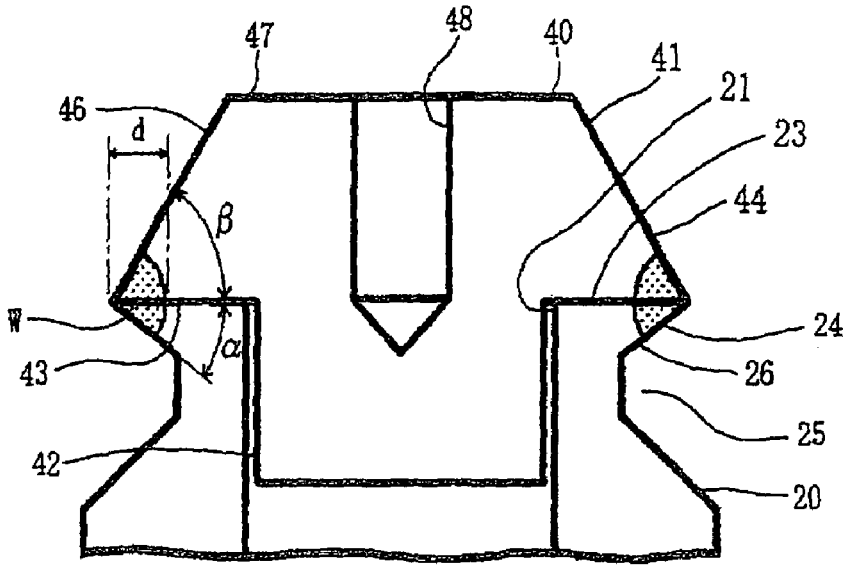
FIG. 3 is an explanatory enlarged view showing a state of the base portion and the lid portion in the anode of FIG. 2.

FIG. 2 shows an enlarged explanatory view of the anode 14 of the discharge lamp, and FIG. 3 shows an enlarged explanatory view showing a state of the base portion and lid portion in the anode of FIG. 2. In these figures, the anode 14 is shown in a state where tip portion 14A which faces the cathode 16 is located in the lower side. In the anode 14, a heat conductive member M is airtightly enclosed inside the sealing space C, which is formed by making a lid portion 40 fit in with a base portion 20, in order to weld them.

The base portion 20 of the anode 14 is a cylinder having an opening 21 on the end surface of a base end portion (end portion opposite to the tip of the anode 14), an interior space 22, and a bottom portion, and further a base portion side flange portion 24 which projects in a diameter outside direction is formed in the base end portion. The base portion side flange portion 24 has a base portion side flat portion 23 which extends in a diameter direction, and a base portion side slope portion 26 which is continuously formed from the perimeter edge of the base portion side flat portion 23 in a diameter inside direction so as to extend toward the tip portion of the base portion (in a lower side of the figure. The base portion side flange portion 24 has an annular groove 25 which is formed in a circumference of the base portion 20 in a position close to the basis end portion thereof, in which the base portion side slope portion 26 is formed as part of the annular groove 25. The outer diameter of the base portion side flange portion 24 is smaller than the outer diameter of the base portion 20. Accordingly, there is an advantage that even after the base portion and the lid portion are welded together, no part becomes larger in diameter than the outer diameter of the base portion, and glass tube material for a conventional arc tube structure can be used at time of the assembly of the discharge lamp.

The lid portion 40 of the anode 14 has a lid portion main body 41 whose shape is a circular truncated cone as a whole, and a cylindrical insertion portion 42 which is integrally formed so as to project from the center of the bottom of the lid portion main body 41. The diameter of the insertion portion 42 is determined so as to fit in with the inner diameter of the interior space which is continuously formed from the opening 21 of the base portion 20. The lid portion main body 41 has a lid portion side flange portion 44 which has the same outer diameter as that of the base portion side flange portion 24. This lid portion side flange portion 44 whose shape is a circular truncated cone has a lid portion side flat portion 43 which extends in a diameter outside direction, and a toric lid portion side slope portion 46 which is continuously formed from the perimeter edge of the lid portion side flat portion 43 so as to extends in a diameter inside direction toward the base end which is opposite to a direction toward the tip). And the insert portion 42 is formed so as to project in the tip direction from the lid portion side flat portion 43. A hole 48 for welding rod connection, with which a welding rod is pressed so as to be fit in, is formed in the center of that base side end surface 47 of the lid portion 40.

As shown in FIG. 3, the base portion side flange apex angle $\alpha$ of the base portion side flange portion 24 which is formed by the base portion side slope portion 26 and the base portion side flat portion 23, is an acute angle of 30 degrees or more but less than 90 degrees in a cross sectional view taken along in the axial direction. The lid portion side flange apex angle $\beta$ of the lid portion side flange portion 44 which is formed by the lid portion side slope portion 46 and the lid portion side flat portion 43, is an acute angle of 30 degrees or more but less than 90 degrees in a cross sectional view taken along in the axial direction. The sum total ($\alpha+\beta$) of the base portion side flange apex angle $\alpha$ and the lid portion side flange apex angle $\beta$ is set to 160 degrees or less.

The insertion portion 42 of the lid portion 40 is inserted in the interior space through the opening 21 of the base portion 20. The lid portion side flat portion 43 of the lid portion side flange portion 44 is brought into close contact with the base portion side flat portion 23 of the base portion side flange portion 24. In that state, the perimeter edge (the tip portion and portion extending therefrom in a cross sectional view taken along in an axial direction) of the base portion side flange portion 24 and the perimeter edge (the tip portion and portion extending therefrom in a cross sectional view taken along in an axial direction) of the lid portion side flange portion 44 which overlap each other are welded, so that an annular welding portion W can formed. The width d in the diameter direction of this annular welding portion W is set to 0.8 to 3.0 mm.

The anode 14 and the cathode 16 are made of metal with a high melting point, for example, metal whose melting point is about 3000 degrees Celsius or more, such as a tungsten, a rhenium, and a tantalum. Among the above metals, the tungsten is preferred. On the other hand, metal for the heat conductive member M which is higher in thermal conductivity at time of lighting, than that of metal for the electrodes, is used. For example, when the electrodes which are made of tungsten, is used, the heat conductive member M is made of a silver, copper, gold, indium, tin, zinc, a lead, etc. Among them, silver, copper, and gold are excellent and, specifically, silver is especially preferred.

The anode is manufactured a method as set forth below. That is, the base portion 20 and the lid portion 40 are produced by performing cutting of a cylindrical member made of tungsten. The heat conductive member M is filled in the interior space of the base portion 20, and the insertion portion 42 of the lid portion 40 is inserted through the opening 21 of the base portion 20 into the interior space of the base portion 20, thereby bringing the lid portion side flat portion 43 into contact on the base portion side flat portion 23, so that the perimeter edge of the base portion side flange portion 24 and the perimeter edge of the lid portion side flange portion 44 which adjoins the base portion side flange portion 24, are welded over all the circumferences thereof. And rare gas is introduced in the sealed enclosed space C through a gas introduction hole (not shown) formed in the lid portion 40. After that, an opening end portion of the gas introduction hole is melted by heat so as to carry out sealing, and the one end of an electrode rod (not shown) is press-fit in a hole 48 for electrode rod connection formed in the lid portion 40, by a pressing unit.

In a discharge lamp having such a structure, overheating of the tip portion 14A (specifically the other end portion of the base portion 20) of the anode 14 can be prevented by enclosing the heat conductive member M which is a heat transferring member, in the sealed enclosed space C of the anode 14.

Moreover, the heat transfer function of the heat conductive member M is explained, below. The thermal conductivity of tungsten is about 100 W/mK in the high temperature region of about 2000 K. On the other hand, each of silver and copper has the thermal conductivity higher than the tungsten. For example, the thermal conductivity of the silver in 2000 K is about 200 W/mK and the thermal conductivity of copper is about 180 W/mK. Therefore, the heat accumulated near the anode tip portion 14A is effectively transferred to the anode back portion 14B which is lower in temperature than the anode tip portion 14A, so that it is possible to prevent the anode tip portion 14A from being overheated. And since any of silver, copper, and gold do not alloy with the tungsten so that they have a function of stably transferring heat as a heat transferring member.

Moreover, when rhenium (the thermal conductivity at 2000 K is about 52 W/mK) is used as a high melting point metal which forms the anode 14, tungsten can be used as the heat conductive member M. If such a structure is applied to a discharge lamp such as a mercury lamp or a metal halide lamp which contains halogen, the anode 14 is not corroded, so that the life span of the discharge lamp can be extended.

Thus, it is possible to prevent the anode tip portion 14A from being overheated, by using the heat conductive member M which has a thermal conductivity higher than that of the anode 14 so that a current flow rate of the discharge lamp can be increased.

Metal having a melting point lower than that of the metal which forms the anode 14 as a heat conductive member M can also be used, instead of the metal which has a high heat conduction property.

For example, when tungsten of which the anode 14 is made, is used, silver, copper, gold, indium, tin, zinc, lead, etc. can be used as the heat conductive member M. In such an anode 14, since the heat conductive member M melts and a convection occurs in the interior of the sealed enclosed space C of the anode 14 at time of lighting of the discharge lamp, so that the heat of the anode tip portion 14A is transferred to the anode back portion 14B, the problem that the electrode melts can be avoided by efficiently transferring the heat accumulated near the anode tip portion 14A. Furthermore, it becomes possible to pass large current through the discharge lamp, so that a large output can be attained.

In the sealed enclosed space C, rare gas is enclosed so as to form a predetermined pressure. In detail, when the heat conductive member M is enclosed as much as 50% or more of the internal volume of the sealed enclosed space C, rare gas of one or more atmospheric pressure is enclosed, thereby preventing generation of air bubbles in the boundary face between the heat conductive member M and the inner surface of the sealed enclosed space C. On the other hand, when a small amount of the heat conductive member M is enclosed compared with the internal volume of the sealed enclosed space C, the heat transfer effect according to boiling can be improved by changing the inner pressure of the sealed enclosed space C into a pressure lower than the atmospheric pressure, thereby accelerating boiling of the heat conductive member.

In the base portion side flange portion 24 of the anode 14 having the above-mentioned structure, the base portion side flange apex angle $\alpha$ which is formed by the base portion side slope portion 26 and the base portion side flat side 23, is an acute angle of 30 degrees or more but less than 90 degrees in a cross sectional view taken along in the axial direction.

In the lid portion side flange portion 44, the lid portion side flange apex angle $\beta$ which is formed by the lid portion side slope portion 46 and the base portion side flat portion 43, is an acute angle of 30 degrees or more but less than 90 degrees in a cross sectional view taken along in the axial direction. The sum total ($\alpha+\beta$) of the base portion side flange apex angle $\alpha$ and the lid portion side flange apex angle $\beta$ is set to 160 or less degrees. In the case where the above condition of the angle $\alpha$ and $\beta$ is met, since the base portion side flange portion 24 of the base portion 20 and the lid portion side flange portion 44 of the lid portion 40 which are welded together, have small heat capacity, it is possible to certainly set the width d in the diameter direction of the toric welding portion W to 0.8 mm or more but 3.0 mm or less (0.8 mm$\leqq$W$\leqq$3.0 mm).

As mentioned above, the diameter direction width d of the toric welding portion W formed by welding the base portion side flange portion 24 and the lid portion side flange portion 44 entirely in a circumferential direction, in a state where the lid portion side flat portion 43 is brought into contact with the base portion side flat portion 23, is set to 0.8 mm or more but 3.0 mm or less. Further, the angles $\alpha$ and $\beta$ are acute angles of 30 degrees or more. In such a case, the following effects are acquired when the sum total of the angles $\alpha$ and $\beta$ is 160 degrees or less.

(1) In case of the diameter direction width d of welding portion w is 0.8-3.0 mm, since light emitting material has not evaporated in an arc tube portion 11 at time of starting of a discharge lamp, the internal pressure of an arc tube portion 11 has not reached a predetermined pressure. However, the temperature of the anode 14 rises promptly and the pressure of the interior space rises, so that the internal pressure of the anode 14 becomes about 4 MPa since the heat conductive member M is enclosed in the sealed enclosed space C of the anode 14. Thus, since the difference between the internal pressure of the arc tube portion 11 and the internal pressure of the anode 14 is large, a force acts in a direction of making the lid portion 40 and the base portion 20 separated from each other. Therefore, when the diameter direction width d of the welding portion W is 0.8 or more, it is possible to obtain sufficient durability against the force. However, when the diameter direction width d of the welding portion W is too short, there is a possibility that the welding portion W may be damaged at time of start of lighting.

On the other hand, when the diameter direction width d of the welding portion W exceeds 3.0 mm, as the required welding energy increases, the welding time becomes longer, so that the base portion 20, the lid portion 40 and the heat conductive member M become very high in temperature, and thereby, the amount of the heat conductive member M may decrease due to evaporation and boiling. Therefore, there is a possibility that it may become impossible to acquire the intended heat transfer effect, and there is a possibility that part of the boiled and dispersed heat conductive member M may enter into the welding portion W, so as to deteriorate the welding portion W, whereby the strength thereof may become low.

For the above reasons, in the embodiment, when the diameter direction width d of the welding portion W is set to 0.8 to 3.0 mm, the strength required for the welding portion W is sufficiently obtained. In addition, there is no possibility that at time of start of the discharge lamp, the anode 14 may be damaged. Furthermore, it is possible to avoid excessive welding energy or welding time at time of welding.

(2) In the case where the base portion side flat portion 23 of the base portion side flange portion 24 and the lid portion side flat portion 43 of the lid portion side flange portion 44 are welded entirely in a circumferential direction in a state where they are brought into close contact with each other, the following effect can be acquired.

Figure 8:
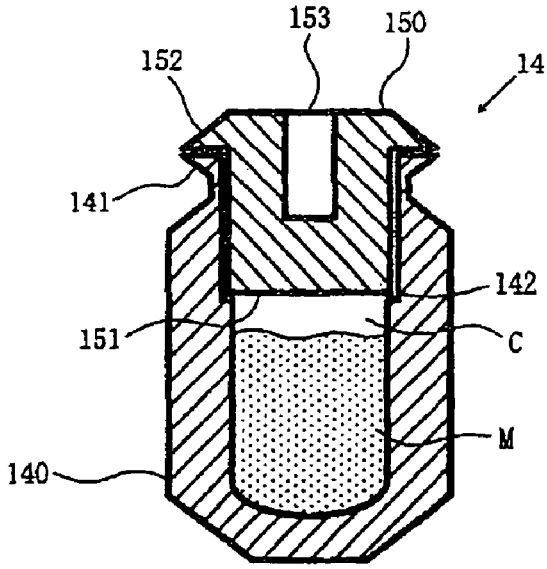
FIG. 8 is explanatory enlarged view showing the structure of an anode of a conventional discharge lamp.

As shown in an FIG. 8, in the conventional electrode, since the tip of the insertion portion 151 of the lid portion 150 is brought into contact with the inner shoulder 142 formed in the inner circumference face of the base portion 140 and a force created when the electrode rod is press-inserted into the lid portion 150, is received by the inner shoulder 142, the base portion side flat portion 23 of the base portion side flange portion 24 of the base portion 140 and the lid portion side flat portion 43 of the lid portion side flange portion 44 of the lid portion 150 are not in close contact with each other, (namely, in a state where there is a minute gap between the base portion side flat portion 23 and the lid portion side flat portion 43). Thus, when the base portion side flange portion 24 and the lid portion side flange portion 44 are welded entirely in a circumferential direction in the state where the base portion side flat portion 23 and the lid portion side flat portion 43 are not in (close) contact with each other, each of the base portion side flange portion 24 and the lid portion side flange portion 44 melts separately, and each of the base portion side flange portion 24 and the lid portion side flange portion 44 becomes round at its circumferential edge, so that it becomes difficult to weld the base portion side flange portion 24 and the lid portion side flange portion 44. Therefore, in such a case, if the diameter direction width d of the welding portion W of the base portion side flange portion 24 and the lid portion side flange portion 44 is made into the above-mentioned length, the required welding energy becomes large, the welding time also becomes long so that the heat conductive member M becomes very high in temperature. Thereby, since the amount of the heat conductive member M may decrease due to evaporation and boiling of the heat conductive member M, it may become impossible to acquire the intended heat transfer effect, and part of the boiled and dispersed heat conductive member M may enter into the welding portion W, so as to deteriorate the welding portion W, whereby the strength thereof may become low. Therefore, since in the state where the base portion side flat portion 23 and the lid portion side flat portion 43 are brought into close contact with each other, the base portion side flange portion 24 and the lid portion side flange portion 44 are welded entirely in a circumferential direction thereof, so that it becomes possible to easily weld the circumferential edge of the base portion side flange portion 24 and that of the lid portion side flange portion 44, so that evaporation or boiling of the heat conductive member does not occur nor does the strength of the welding portion W deteriorate, whereby it is possible to make the diameter direction width d into a desired one.

Moreover, in the conventional electrode shown in FIG. 8, when the contact area of the inner shoulder 142 of the base portion 140 which is in contact with the insertion portion 151 of the lid portion 150 is small, the inner shoulder 142 is damaged according to the force produced in case the electrode rod is press-inserted in the lid portion 150, so that the lid portion 150 is no longer supported by the inner shoulder 142, whereby the cracks are created in the welding portion W since the force produced in case the electrode rod is press inserted in the welding portion W is added to the welding portion W, and in the worst case, there is a possibility that the heat conductive member M enclosed therein may leak out into the electrical discharge space at time of lighting of a discharge lamp. Therefore, since in the state where the base portion side flat portion 23 and the lid portion side flat portion 43 are brought into close contact with each other, the base portion side flange portion 24 and the lid portion side flange portion 44 are welded entirely in a circumferential direction thereof, the force added to the lid portion 40 when an electrode rod is press-inserted in the lid portion 40, is received by the base portion side flat portion 23 which is brought into close contact with the lid portion side flat portion 43, it is possible to prevent this force from being applied to the welding portion W when the electrode rod is press-inserted therein. Since cracks can be prevented from being created in the welding portion W, it is possible to prevent the heat conductive member M from leaking out into the electrical discharge space at time of lighting of the discharge lamp.

(3) In case where the angle $\alpha$+angle $\beta$ is 160 degrees or less, when the wall thickness of the base portion side flange portion 24 and that of the lid portion side flange portion 44 becomes large when the sum total of the angle $\alpha$ and the angle $\beta$ exceeds 160 degrees, it is hard to promptly increase the temperature thereof at time of welding, so that it is necessary to increase welding energy or the weld time. However, as discussed above, in such a case, due to evaporation and boiling of the heat conductive member M, it is difficult to acquire the intended heat transfer effect, and part of the boiled and dispersed heat conductive member M may enter into the welding portion W, so as to deteriorate the welding portion W, whereby the strength thereof may become low. Therefore, since the temperature can promptly rise at time of welding when the angle $\alpha$+the angle $\beta$ is 160 degrees or less, it is possible to set the diameter direction width d of the welding portion W to 0.8-3.0 mm, so that it is possible to fully obtain the strength required for the welding portion W, and in addition, it is possible to avoid damage to the welding portion W at time of starting of the discharge lamp, and to avoid the excessive welding energy at time of welding.

(4) In case that angles $\alpha$ and $\beta$ are 30 degrees or more, since when both or one of the angles $\alpha$ and $\beta$ are less than 30 degrees, the temperature of the base portion side flange portion 24 and/or the lid portion side flange portion 44 rapidly and locally rise at time of beginning of welding, there is a possibility that cracks (crack) may occur in the base portion side flange portion 24 and/or the lid portion side flange portion 44. Especially, when the base portion 20 and the lid portion 40 are made of tungsten which is a brittle metal, it is easy to produce such a phenomenon. When cracks do not extend in depth, it may be able to get rid of them. However, in case of both or one of the angles $\alpha$ and $\beta$ are less than 30 degrees, it is difficult to carry out such a repair, so that the cracks remain after the welding. As a result, there is a possibility that the enclosed heat conductive member M leaks out. Accordingly, in the present embodiment, since the angles $\alpha$ and/or $\beta$ is 30 degrees or more, it is possible to prevent generation of cracks in the base portion side flange portion 24 and the lid portion side flange portion 44 which are caused by welding, and to prevent the cracks from remaining therein after the welding.

Thus, although the embodiments are explained above, it is possible to make various changes thereto.

FIGS. 4-7 are explanatory cross sectional views showing various modifications to the lid portion 40.

Figure 4:
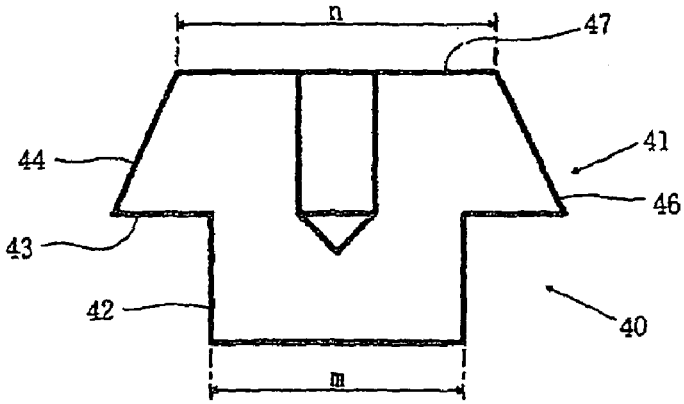
FIG. 4 is an explanatory cross sectional view showing an example of a lid portion.

In FIG. 4, a base side end surface 47 of a truncated cone lid portion main body 41 in a lid portion 40 has the outer perimeter n which is larger than the outer diameter m of an insertion portion 42.

Figure 5:
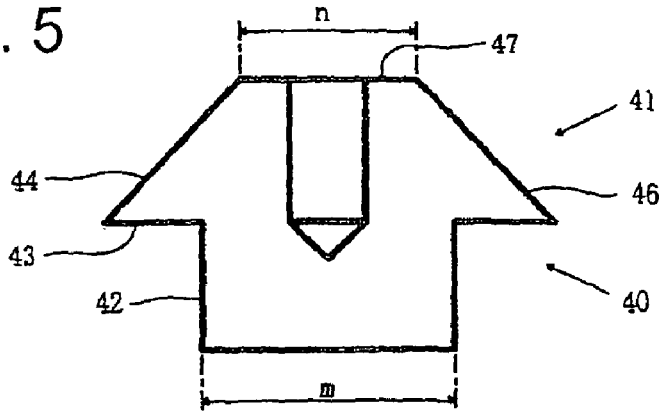
FIG. 5 is an explanatory cross sectional view showing another example of a lid portion.

In FIG. 5, a base side end surface 47 of a truncated cone lid portion main body 41 in a lid portion 40 has the outer diameter n which is smaller than the outer diameter m of an insertion portion 42.

Figure 6:
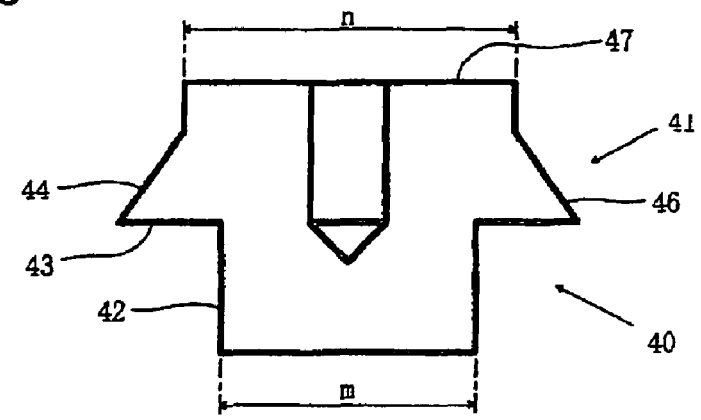
FIG. 6 is explanatory cross sectional view showing a still another example of a lid portion.

Moreover, in FIG. 6, a lid portion main body 41 of a lid portion 40 has a truncated cone portion and a cylindrical portion which is integrally and continuously formed with the truncated cone portion toward the base end side. The outer diameter n of the cylindrical portion is larger than the outer diameter m of an insertion portion 42.

Figure 7:
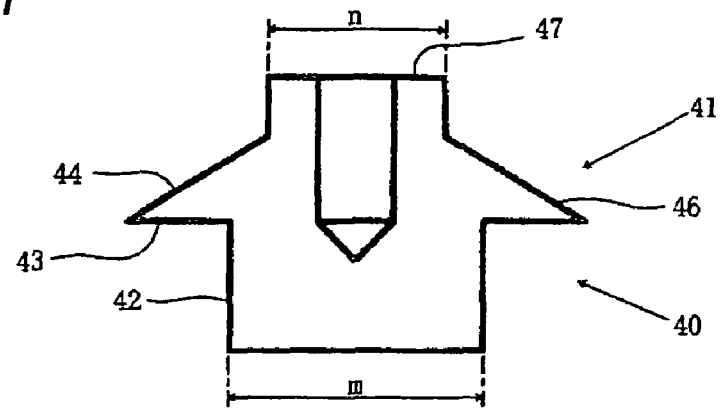
FIG. 7 is explanatory cross sectional view showing still another example of a lid portion.

In FIG. 7, a lid portion 40 has a lid portion main body 41 whose structure is similar to that of FIG. 6, but the outer diameter n of a cylindrical portion is smaller than the outer diameter m of an insertion portion 42.

The following experiments were conducted in order to check the effect of the embodiments.

[Experiments]

The anode having the base portion and lid portion as described below are prepared by cutting.

The outer diameter of the cylinder of the base portion was 29 mm, the height thereof was 60 mm, the outer diameter of the base portion side flange portion was 27 mm, the width of the base portion side flat portion was 4 mm, and the angle α of the base portion side flange apex angle was 60 degrees. The outer diameter of the lid portion side flange portion was 27 mm, the width of the lid portion side flat portion was 3.8 mm, and the lid portion side flange apex angle β was 60 degrees. The base portion and the lid portion were welded, and silver was enclosed as a heat conductive member M in the sealed enclosed space, so that electrodes are prepared, but in each of which the diameter direction width d of the annular welding portion varies so that welding condition varies.

Next, arc tubes, in each of which the internal volume of an arc tube portion was 850 $cm^3$, are produced. Each electrode was installed in an arc tube which was produced by the above method, and the discharge lamps in which mercury of 50 $mg/cm^3$ was enclosed as a light-emitting material in the arc tube were produced.

Each discharge lamp produced in the above manner was turned on under the lighting conditions of electric power 12000 W, and existence of peeling of the welding portion in the base portion and the lid portion, and existence of evaporation of the heat conductive member M due to heat generated by welding when the electrode was formed were examined.

The result of the experiments is shown in Table 1.

TABLE 1

| d (mm) | Existence or nonexistence of peeling of welding portion in a base portion and a lid portion at time of lighting | Existence or nonexistence of evaporation of a heat conductive member M at time of welding |
|---|---|---|
| 0.6 | X | ○ |
| 0.8 | ○ | ○ |
| 1.5 | ○ | ○ |
| 2.0 | ○ | ○ |
| 2.5 | ○ | ○ |
| 3.0 | ○ | ○ |
| 3.2 | ○ | X |

Moreover, base portions and lid portions were made under cutting conditions shown in the Table 2 in which the base portion side flange apex angle α and the lid portion side flange apex angle β varied. The diameter direction width d of the welding portion formed by welding one of the base portions and one of the lid portions, existence or nonexistence of cracks generated in the base portion and the lid portion due to heat at time of welding, and the existence or nonexistence of evaporation of the heat conductive member M due to heat at time of welding, were examined. The result is shown in Table 2.

TABLE 2

| α (Degrees) | β (Degrees) | α + β (Degrees) | d (mm) | Existence or nonexistence of cracks: Base portion | Existence or nonexistence of cracks: Lid portion | Existence or non-existence of evaporation of a heat conductive member M at time of welding |
|---|---|---|---|---|---|---|
| 20 | 30 | 50 | 1.0 | X | ○ | ○ |
| 30 | 20 | 50 | 1.0 | ○ | X | ○ |
| 30 | 30 | 60 | 1.0 | ○ | ○ | ○ |
| 30 | 45 | 75 | 1.0 | ○ | ○ | ○ |
| 45 | 30 | 75 | 1.0 | ○ | ○ | ○ |
| 70 | 70 | 140 | 1.1 | ○ | ○ | ○ |
| 80 | 70 | 150 | 1.0 | ○ | ○ | ○ |
| 80 | 80 | 160 | 0.8 | ○ | ○ | ○ |
| 90 | 80 | 170 | 0.8 | ○ | ○ | X |

The diameter direction width d of the annular welding portion was measured as set forth below. Namely, a cross section obtained by cutting the electrode along a plane including the axis thereof was ground and a portion to be welding portion was etched. In a state where the crystal state of the electrode structure material in a cross section of the welding section could be easily seen, the crystal of the electrode structure material in the cross section of the welding section was observed by a microscope, and based on the difference between the crystal state of the welding section and the crystal structure of other portions, the diameter direction width d of the welding section was obtained by measuring, with a slide caliper, the width of a portion whose crystal state is different from that of the other portions.

From the experimental result shown in Table 1, when the diameter direction width d of the welding portion exceeds 3.0 mm, it is considerable that the heat conductive member M enclosed in the sealed enclosed space evaporates. Moreover, from the experimental result of Table 2, when the angle of α+β exceeds 160 degrees, when trying to obtain the diameter direction width of 0.8 mm or more, the heat conductive member M evaporated.

The preceding description has been presented only to illustrate and describe exemplary embodiments of the discharge lamp according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp comprising:

an arc tube; and a pair of electrodes arranged in the arc tube, wherein one of the electrodes comprises a cylindrical metallic base portion having a base portion cylindrical hole extending partially into the base portion at least to a depth commencing at an opening into the base portion cylindrical hole at a base end portion and a bottom portion and a metallic lid portion having a cylindrical insertion portion, a metal having a thermal conductivity higher than that of the base portion or having a melting point lower than that of the base portion is enclosed in a sealed space formed by inserting the insertion portion of the lid portion and an interior of the base portion, and welding the lid portion and the base portion, the base portion has a base portion side flange portion which extends in a diameter outside direction, the base portion side flange has a base portion side flat portion which extends in the diameter direction, and a base portion side slope portion which is continuously formed from a base portion side flat portion perimeter edge of the base portion side flat portion, and extends toward a tip portion of the base portion in a diameter inside direction, the lid portion has a lid portion side main body including a lid portion side flange portion having a diameter approximately equal to an outer diameter of the base portion side flange portion, and an insertion portion, the lid portion side flange portion has a lid portion side flat portion which extends in a diameter outside direction and a lid portion side slope portion which is continuously formed from a lid portion side flat portion perimeter edge of the lid portion side flat portion, and extends toward the base end portion so as to incline toward the diameter inside direction, the insertion portion projects from the lid portion side flat portion and extends therefrom at an insertion portion length, with the insertion portion inserted into the base portion cylindrical hole, the base portion side flange portion and the lid portion side flange portion are welded entirely in a circumferential direction in a state where the base portion side flat portion and the lid portion side flat portion contact each other so as to form a circular welding portion, a diameter direction width of the circular welding portion is 0.8 to 3.0 mm, the base portion cylindrical hole has a uniform base portion cylindrical hole diameter and the insertion portion has a cylindrical shape and an insertion portion diameter smaller than the uniform base portion cylindrical hole diameter such that the insertion portion is disposed apart from the base portion in a non-contacting manner at a distance to form an annular space between the insertion portion and the base portion.

2. The discharge lamp according to claim 1, wherein a base portion side flange apex angle $\alpha$ in a cross section in an axis direction, formed by the base portion side flat portion and the base portion side slope portion is an acute angle of 30 degrees or more, and a lid portion side flange apex angle $\beta$ in a cross section in the axis direction, formed by the lid portion side flat portion and the lid portion side slope portion is an acute angle of 30 degrees or more, and a sum total of the angle $\alpha$ and the angle $\beta$ is 160 degrees or less.

3. The discharge lamp according to claim 2, wherein a circumference surface of the base portion has an annular groove which is formed in a circumference of the base portion, in which the base portion side slope portion is part of the annular groove.

4. The discharge lamp according to claim 3, wherein the diameter of the base portion side flange portion is approximately equal to or less than that of a cylinder which forms the base portion.

5. The discharge lamp according to claim 2, wherein the diameter of the base portion side flange portion is approximately equal to or less than that of a cylinder which forms the base portion.

6. The discharge lamp according to claim 1, wherein a circumference surface of the base portion has an annular groove which is formed in a circumference of the base portion, in which the base portion side slope portion is part of the annular groove.

7. The discharge lamp according to claim 6, wherein the diameter of the base portion side flange portion is approximately equal to or less than that of a cylinder which forms the base portion.

8. The discharge lamp according to claim 1, wherein the diameter of the base portion side flange portion is approximately equal to or less than that of a cylinder which forms the base portion.

* * * * *